US009051114B2

(12) United States Patent
Ambs

(10) Patent No.: US 9,051,114 B2
(45) Date of Patent: Jun. 9, 2015

(54) FOREIGN OBJECT BARRIER DEVICE FOR BULK MATERIAL CONVEYING DUCTS

(75) Inventor: Richard W. Ambs, Williamsport, PA (US)

(73) Assignee: THE YOUNG INDUSTRIES, INC., Muncy, PA (US)

( * ) Notice: Subject to any disclaimer, the term of this patent is extended or adjusted under 35 U.S.C. 154(b) by 244 days.

(21) Appl. No.: 13/313,239

(22) Filed: Dec. 7, 2011

(65) Prior Publication Data

US 2013/0149050 A1 Jun. 13, 2013

(51) Int. Cl.

| | |
|---|---|
| ***B65D 88/70*** | (2006.01) |
| ***B65D 88/68*** | (2006.01) |
| ***B65D 90/22*** | (2006.01) |

(52) U.S. Cl.

CPC ..... *B65D 88/68* (2013.01); *B65D 90/22* (2013.01)

(58) Field of Classification Search

CPC ..... B65D 88/70
USPC ..... 406/55, 191
See application file for complete search history.

(56) References Cited

U.S. PATENT DOCUMENTS

| | | | | |
|---|---|---|---|---|
| 3,197,259 | A * | 7/1965 | Braun-Angott | 406/146 |
| 3,756,475 | A * | 9/1973 | Emery | 222/195 |
| 3,870,374 | A * | 3/1975 | Wentzel et al. | 406/89 |
| 3,905,650 | A * | 9/1975 | Freeman | 406/94 |
| 3,989,310 | A * | 11/1976 | Aller | 406/14 |
| 4,172,618 | A * | 10/1979 | Lambert | 406/90 |
| 4,582,254 | A * | 4/1986 | Rotolico et al. | 239/80 |
| 4,722,641 | A * | 2/1988 | Reeves, Jr. | 406/137 |
| 5,570,170 | A * | 10/1996 | Muranyi et al. | 399/262 |
| 6,484,902 | B1 * | 11/2002 | Rouse | 221/278 |
| 6,485,284 | B1 * | 11/2002 | Rowland et al. | 425/78 |
| 7,320,561 | B2 * | 1/2008 | Ambs | 406/31 |
| 7,648,563 | B2 * | 1/2010 | Doehla et al. | 95/273 |
| 2005/0269369 | A1 * | 12/2005 | Pfeiffer et al. | 222/367 |
| 2010/0254790 | A1 * | 10/2010 | Tkachyk | 414/311 |
| 2011/0014020 | A1 * | 1/2011 | Thiessen | 414/326 |

* cited by examiner

*Primary Examiner* — Gene Crawford
*Assistant Examiner* — Thomas Randazzo
(74) *Attorney, Agent, or Firm* — Novak Druce Connolly Bove + Quigg LLP

(57) ABSTRACT

A device disposable between upstream and downstream openings of components conveying a fine bulk material, including a housing displaceable between such component openings, having an opening therethrough for conducting such material, and at least one conduit supported on such housing, spanning the opening in such housing, in the path of the flow of such material therethrough, formed of a porous material, connectable to a source of fluid.

20 Claims, 3 Drawing Sheets

FOREIGN OBJECT BARRIER DEVICE FOR BULK MATERIAL CONVEYING DUCTS

This invention relates to a device mountable in a duct conveying a fine bulk material, functional to preclude the passage of foreign objects yet effective to facilitate the flow of such bulk material.

BACKGROUND OF THE INVENTION

In various industrial processes, it often is provided to gravity feed fine bulk material through ducts to various types of equipment including valves, mixers, grinders, screeners, storage vessels, receptacles and the like. Often, such ducts are provided with certain forms of barriers to prevent various objects such as tools, machine parts, large pieces of material and the hands of human operators from entering into and extending through such ducts, possibly causing damage to downline equipment, interrupting or deterring the flow of material being processed or causing injury to operators.

In the prior art, there have been a number of such barriers for ducts developed and deployed. However, such prior art devices have been found not to be fully effective in ensuring the free flow of fine bulk material while precluding the passage of large objects such as tools, machine parts and like and preventing the insertion and possible injury to the hands of operators. It thus is the principal object of the present invention to provide a device disposable in the path of a fine bulk material within a duct or other conveyance means, provided with a barrier which will screen out and retain various objects such as tools, machine parts and the like, and prevent the harmful penetration of the hands and arms of operators but will not only allow and facilitate the steady flow of bulk materials but function to disperse agglomerations of such bulk materials deposited on and/or between components of such barriers.

SUMMARY OF THE INVENTION

The principal object of the present invention is achieved by providing a device disposable between upstream and downstream ducts conveying a bulk material generally including a housing disposable between openings of such ducts, provided with an opening therethrough for conducting such material, and at least one conduit supported on such housing, spanning the opening therethrough, in the path of the flow of such material therethrough, formed of a porous material, connectable to a source of fluid under pressure. Preferably, a number of such conduits being provided, each of such conduits being formed of a multi-layered wire mesh provided with a finished contact surface and each of such conduits being provided with a circular, elliptical or diamond cross-sectional configuration.

DETAILED DESCRIPTION OF THE PREFERRED EMBODIMENT OF THE INVENTION

Figure 1:
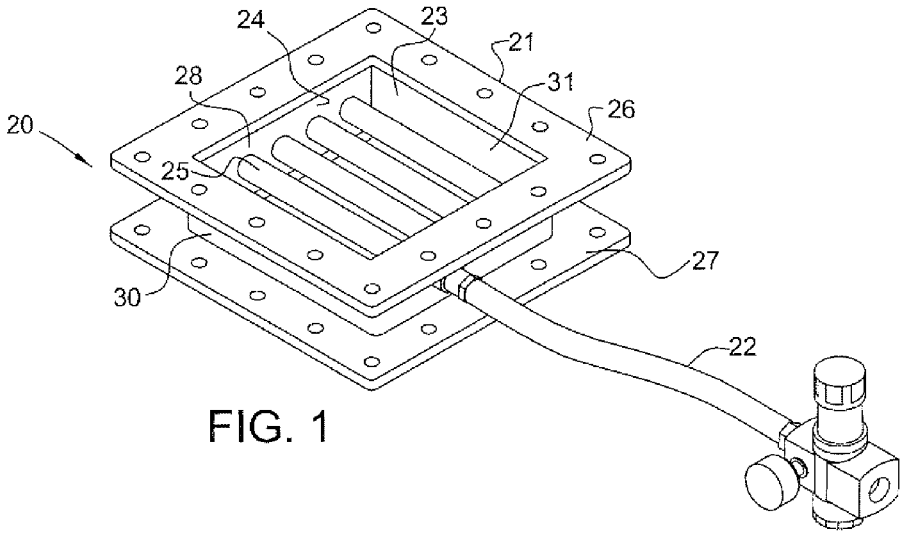
FIG. 1 is a perspective view of a device embodying the present invention.
Figure 2:
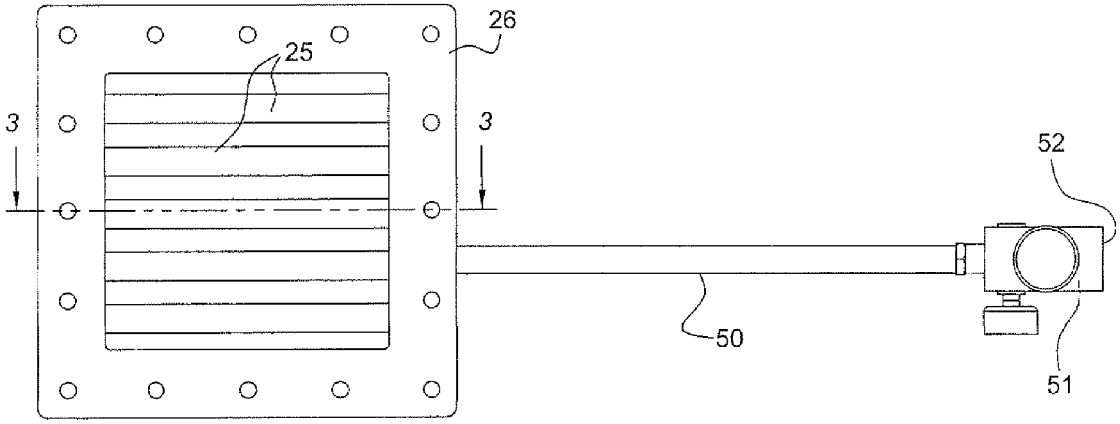
FIG. 2 is an enlarged top plan view of the device shown in FIG. 1.
Figure 3:
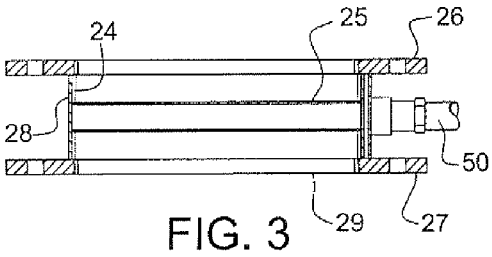
FIG. 3 is a cross sectional view taken along line 3-3 in FIG. 2.
Figure 4:
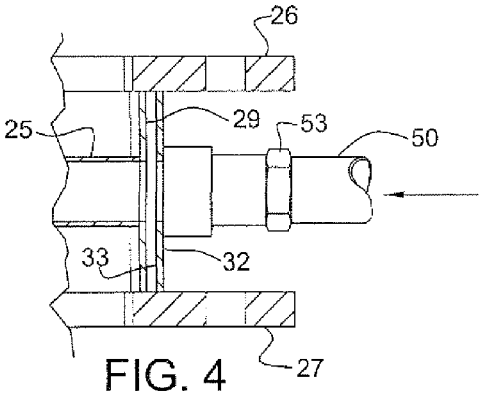
FIG. 4 is an enlarged, fractional view of a portion of the device shown in FIG. 3.

Referring to FIGS. 1 through 4 of the drawings, there is illustrated a device 20 embodying the present invention which includes an assembly 21 having an opening therethrough for conducting a flow of bulk material, and an assembly 22 for supplying a fluid under pressure to the opening in assembly 21. Assembly 21 includes a peripheral wall 23 defining a through opening 24, a set of spaced grates 25 mounted on peripheral wall 23, spanning through opening 24 and a pair of spaced mounting flanges 26 and 27. Peripheral wall 23 is substantially rectangularly configured including a pair of spaced end walls 28 and 29 (see FIG. 4) and a pair of spaced walls 30 and 31 interconnecting spaced walls 28 and 29 to provide opening 24. Mounting flanges 26 and 27 are disposed in substantially spaced, parallel planes, and are secured to the upper and lower ends of peripheral wall 23. As best seen in FIGS. 3 and 4, a wall member 32 is provided between portions of mounting flanges 26 and 27, spaced from housing wall 29 and having end portions bent and secured to housing wall 29 to provide a chamber 33 between housing wall 29 and wall member 32.

Figure 7:
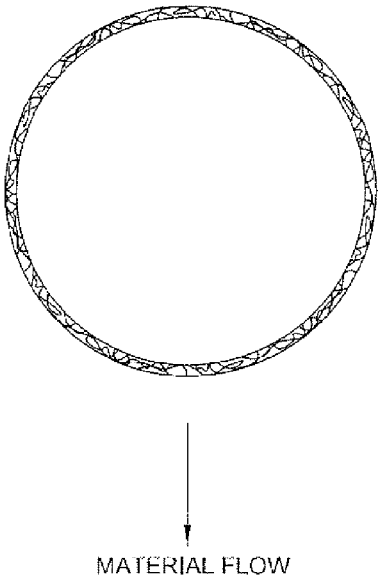
FIGS. 7 through 10 are enlarged, various cross-sectional views of a grate of the device shown in FIGS. 1 through 6.
Figure 8:
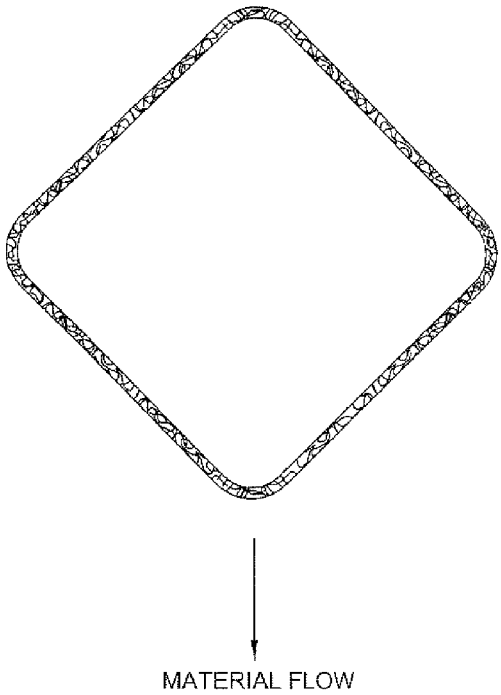
Figure 9:
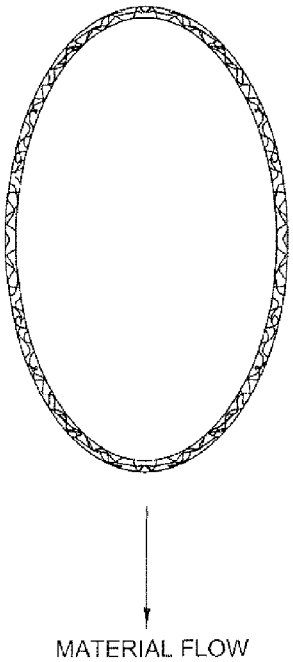
Figure 10:
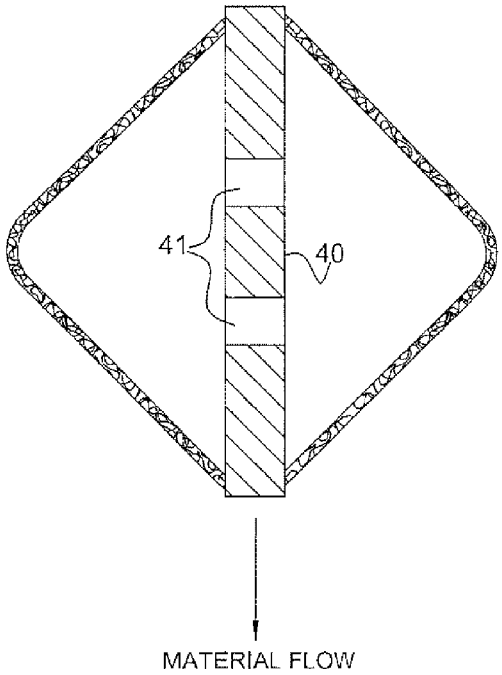

Each of grates 25 is hollow along the length thereof having one end connected to and closed by housing wall 28 and the opposite end thereof connected to housing wall 29 and communicating with chamber 33 through an opening in housing wall 29. Each of such grates further is formed of a multi-layered wire mesh provided with a finished contact surface, a type of material manufactured and sold by The Young Industries, Inc of Muncy, Pa. under the trademark TRANS-FLOW. Such material is rigid but porous, permitting a fluid under pressure applied to the interior of such grates to penetrate the wall thereof and provide a boundary layer of fluid about the outer periphery of the grate. The cross-sectional configuration each of such grates can be circular as shown in FIG. 7, diamond-shaped as shown in FIG. 8, elliptical as shown in FIG. 9 or diamond-shaped as shown in FIG. 10 provided with a partition wall 40 connecting opposing sides of the grate and provided with a set of openings 41 intercommunicating the spaced chambers of the grate.

Peripheral wall 23 may be rectangular as shown or of any other configuration including circular and polygonal configurations. Mounting flanges 26 and 27 similarly may be rectangularly configured, circular or polygonally configured. Such mounting flanges further would be provided with sets of bolt openings about the peripheries thereof to permit assembly 21 to be disposed and connected between a pair of aligned ducts used to convey a bulk material or a duct and an aligned inlet of a valve, mixer, grinder, screener, storage vessel, receptacle and the like for conducting a bulk material into such a piece of equipment. Fluid supply assembly 22 includes a fluid line 50 provided with regulator 51 having an inlet 52. As best shown in FIGS. 3 and 4, fluid line 50 is provided with a device 53 for detachably connecting fluid line 50 to a receptacle 54 attached to wall member 32 communicating with chamber 33. Inlet 52 of regulator 51 is adapted to be connected to a source of fluid under pressure such as a compressor to provide fluid under regulated pressure through fluid line 50, chamber 32, through grates 25 and the pores thereof into through opening 23 of assembly 21.

Figure 5:
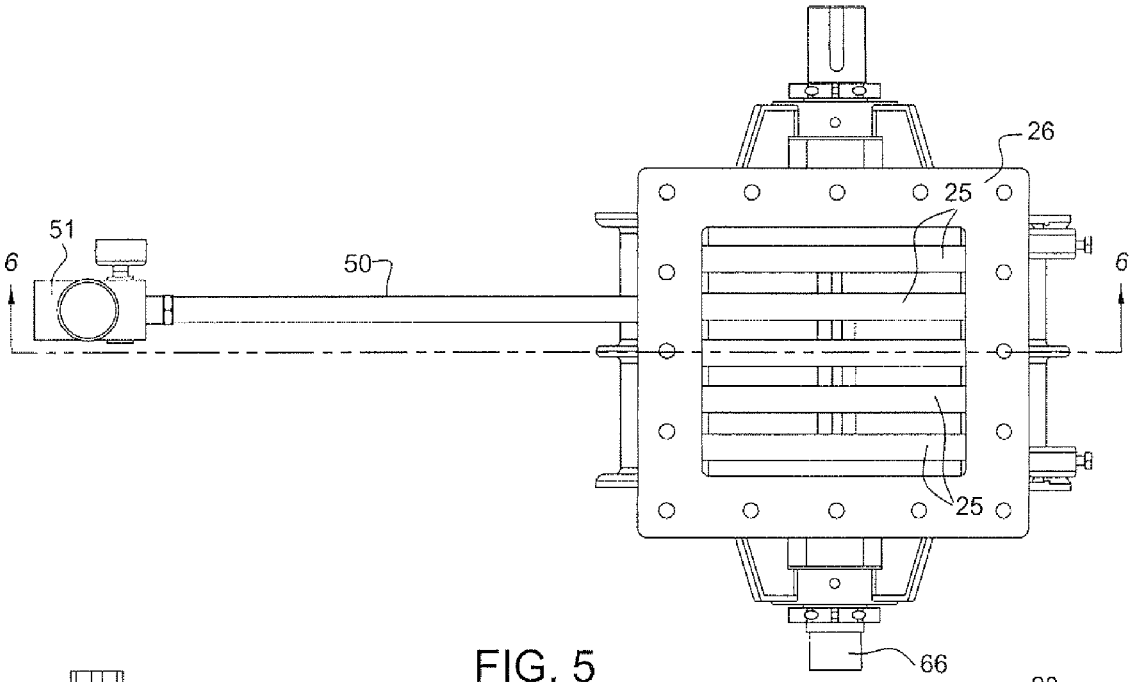
FIG. 5 is a top plan view of the device shown in FIGS. 1 through 4 mounted on the inlet of a rotary valve.
Figure 6:
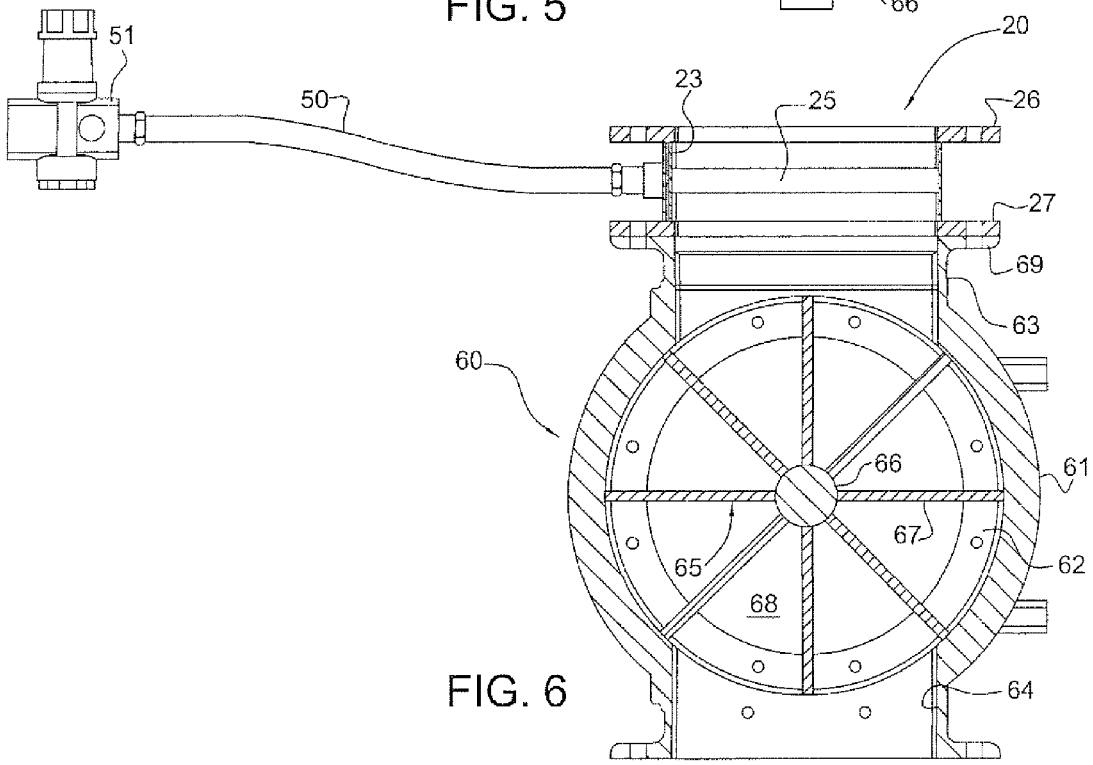
FIG. 6 is a cross-sectional view taken line 6-6 in FIG. 5.

Referring to FIGS. 5 and 6, there is illustrated the device 20 mounted on a rotary valve 60. Such valve includes a housing 61 defining a cylindrical chamber 62 between a pair of end walls, having an inlet 63 and an outlet 64, a rotor 65 disposed in chamber 62 provided with a shaft 66 journaled in the end walls of the housing, provided with a set of radially disposed vanes 67 defining a plurality of pockets 68.

Assembly 20 may be mounted on valve 60 by mounting flange 27 on cooperating mounting flange 63 of valve 60 as shown in FIG. 6 and securing such flanges together by means of bolts inserted through aligned openings. Such mounting would align opening 23 of assembly 20 with inlet 63 of the valve. A duct for conveying bulk material to valve 60, provided with a suitable mounting flange then would be mounted on and connected to mounting flange 26 of assembly 20 to align such duct with the inlet of the valve.

With assembly 20 mounted on valve 60 and a material conducting duct being mounted on assembly 20, bulk material may be fed through such duct and assembly 20 into valve 60 which would convey such material out through outlet 64. In the event any foreign object such as a tool or piece of material or the hand or limb of an operator were inserted into the conveying duct, grates 25 would serve as a barrier to prevent such object from being introduced into valve 60. When such valve would be in operation and bulk material would be fed through the duct and assembly 20 into the valve, fluid hereunder pressure is supplied through fluid line 50 and is caused to penetrate through the pores of the grates to form a boundary layer of fluidizing gas about the periphery of each of the grates. Such boundary layers of fluidizing gas would function to prevent the accumulation of cohesive bulk material on the grates which would obstruct the free flow of bulk material through such duct and assembly 20 into valve 60. The pressure of air introduced into the interiors of the grates and flowing through the pores thereof would be controlled by regulator 51.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. A device disposable between upstream and downstream openings of components conveying a fine hulk material, comprising:

a housing displaceable between said component openings, having an opening therethrough for conducting said material;

at least one conduit for intercepting and retaining objects disposed in said flow of material, rigidly supported at ends thereof on said housing, spanning and spaced laterally of opposed wall portions of said housing opening, in the path of the flow of said material therethrough, formed of a porous material, connectable to a source of fluid under pressure.

2. A device according to claim 1 wherein said conduit is provided with one of a circular, elliptical and diamond cross-sectional configuration.

3. A device according to claim 1 wherein said conduit is formed of a multi-layered wire mesh provided with a finished contact surface.

4. A device according to claim 1 wherein said conduit is provided with a diamond-shaped cross-sectional configuration, a maximum cross-sectional length disposed in alignment with a line of flow of bulk material through said housing opening and a partition wall disposed along said maximum cross-sectional length.

5. A device according to claim 4 wherein said partition wall includes at least one opening therethrough intercommunicating a pair of compartments of said conduit.

6. A device according to claim 1 including a conduit for supplying fluid under pressure to an inlet of said porous conduit, wherein said fluid supplying conduit includes a pressure regulator.

7. A device according to claim 1 including a plurality of said conduits, spaced transversely in said housing opening.

8. A device according to claim 7 wherein said porous conduits are spaced parallel relative to each other.

9. A device according to claim 7 wherein each of said porous conduits is provided with one of a circular, elliptical and diamond cross-sectional configuration.

10. A device according to claim 7 wherein each of said porous conduits is formed of a multi-layered wire mesh provided with a finished contact surface.

11. A device according to claim 7 wherein one of said porous conduits is provided with a diamond-shaped cross-sectional configuration, a maximum cross-sectional length disposed in alignment with a line of flow of bulk material through said housing opening and a partition wall disposed along said maximum cross-sectional length.

12. A device according to claim 11 wherein said partition wall includes at least one opening therethrough intercommunicating a pair of compartments of said porous conduit.

13. A device according to claim 7 including a conduit for supplying fluid under pressure to an inlet of said porous conduit, wherein said fluid supply conduit includes a pressure regulator.

14. A device according to claim 7 wherein said housing includes a manifold provided with an inlet communicable with a source of fluid under pressure, and an outlet communicating with an inlet of said porous conduit.

15. A device according to claim 14 including a conduit for supplying fluid under pressure to said manifold, wherein said fluid supply conduit is provided with a pressure regulator.

16. A device according to claim 1 wherein said housing includes mounting flanges disposed about the inlet and outlet of said housing opening.

17. A device according to claim 16 wherein a wall of said housing, said flanges and a wall between said flanges define a manifold, and said manifold includes an inlet communicable with a source of fluid under pressure and an outlet communicating with said porous conduit inlet.

18. A device according to claim 17 including a fluid supply conduit connected to said inlet of said manifold, wherein said fluid supply conduit includes a regulator.

19. A device according to claim 16 wherein at least one of said mounting flanges is connectable to a cooperating flange of a duct.

20. A device according to claim 16 wherein one of said mounting flanges is connectable to a cooperating flange of one of a duct, machine and receptacle.

* * * * *